United States Patent [19]

Slocum

[11] Patent Number: 4,788,808

[45] Date of Patent: Dec. 6, 1988

[54] BUILDING PANEL AND METHOD OF FABRICATION

[76] Inventor: Donald H. Slocum, 61 Chimney Ridge Rd., Convent Station, N.J. 07961

[21] Appl. No.: 31,571

[22] Filed: Mar. 30, 1987

[51] Int. Cl.[4] ..... E04C 1/40; E04D 1/28; E04D 1/34

[52] U.S. Cl. ..... 52/521; 52/309.8; 52/309.15; 52/523; 52/543; 52/560

[58] Field of Search ..... 52/528, 529, 519, 520, 52/526, 527, 539, 540, 560, 521, 523, 525, 536, 542, 543, 309.4, 309.8, 309.13, 309.15

[56] References Cited

U.S. PATENT DOCUMENTS

| | | | |
|---|---|---|---|
| 2,231,008 | 2/1941 | Ochs | 52/536 |
| 2,264,546 | 12/1941 | Ochs | 52/529 |
| 2,400,357 | 5/1946 | Krajci | 52/539 |
| 2,811,118 | 10/1957 | Ball | 52/536 |
| 2,823,140 | 2/1958 | Lowell | 52/309.13 |
| 2,961,804 | 11/1960 | Beckman | 52/539 |
| 3,228,164 | 1/1966 | Ettore | 52/539 |
| 3,284,967 | 11/1966 | Elliott et al. | 52/539 |
| 3,397,496 | 8/1968 | Sohns | 52/536 |
| 3,581,779 | 6/1971 | Sylvia, Jr. | 52/309.13 |
| 3,866,378 | 2/1975 | Kessler | 52/536 |
| 4,034,528 | 7/1977 | Sanders et al. | 52/527 |
| 4,065,899 | 1/1978 | Kirkhuff | 52/527 |
| 4,078,349 | 3/1978 | Gantner | 52/540 |
| 4,399,643 | 8/1983 | Hafner | 52/543 |
| 4,586,304 | 5/1986 | Flamand | 52/309.8 |

FOREIGN PATENT DOCUMENTS

| | | | |
|---|---|---|---|
| 476698 | 9/1951 | Canada | 52/521 |

*Primary Examiner*—Michael Safavi

*Attorney, Agent, or Firm*—Arthur L. Frederick; Edgar A. Zarins; Malcolm L. Sutherland

[57] ABSTRACT

A building panel of laminated construction having a flat, four-sided polygonal shaped hardboard sheet to one surface of which is bonded a thin, flat, plastic sheet having weather resistant properties and a rigid foam plastic layer having heat insulating properties bonded to the other surface of the hardboard sheet. The foam plastic layer has a tapered shape in cross section with the taper extending from a lower edge portion to a narrow upper edge portion. The hardboard and plastic sheets have an integral flanged lower edge portion in partial abutment with the lower edge portion of the foam plastic layer. A notch in the lower edge portion of the foam plastic layer adjacent the flanged lower edge portion, which notch is constructed and arranged to receive the upper edge portion of an adjacent lower building panel and thereby anchor the lower edge portion of the building panel and provide a seal at the joint.

The method of fabrication includes the steps of forming the integral flanged lower edge portion by providing a V-shaped groove spaced from and parallel to the lower edge of the hardboard to a depth substantially at the surface of the plastic sheet without penetration of the latter and folding along the apex of the groove so as to bring the surfaces of the groove into abutment the plastic sheet at the apex serving as a hinge.

12 Claims, 2 Drawing Sheets

FIG. 6
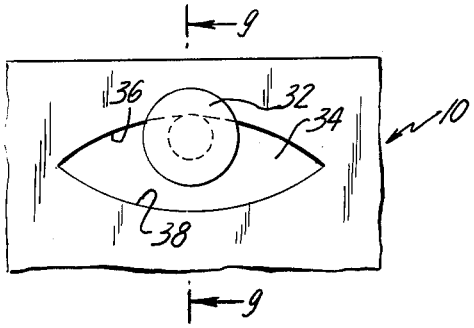
FIG. 7
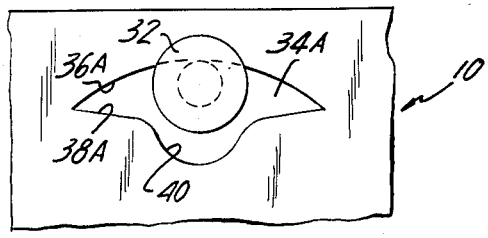
FIG. 8
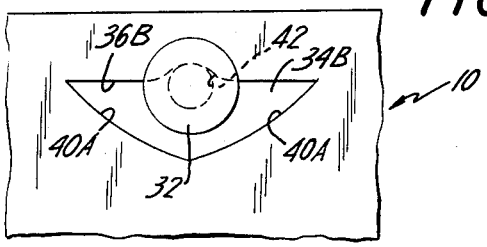
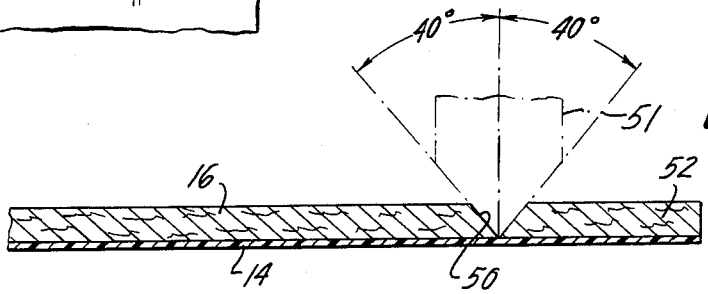
FIG. 10
FIG. 11
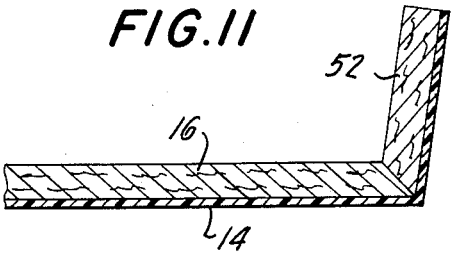
FIG. 12
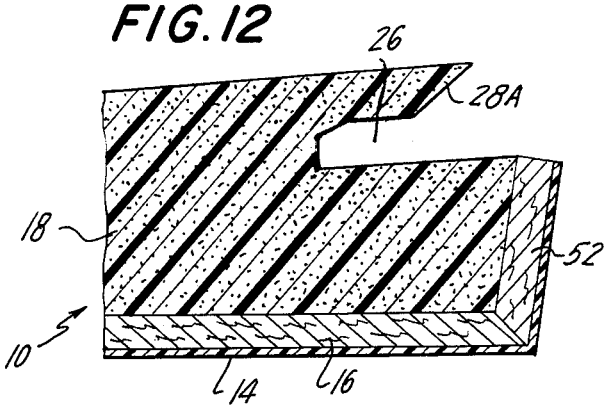
FIG. 9
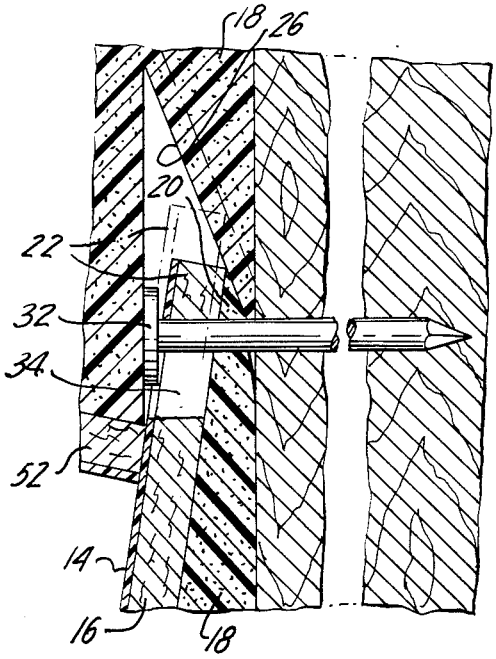

BUILDING PANEL AND METHOD OF FABRICATION

This invention relates to a building panel for use as exterior siding and, more particularly, to a building panel having thermal insulation and a method of fabricating such panel.

BACKGROUND OF THE INVENTION

Heretofore, building panels having thermal insulation of plastic foam and a facing layer of vinyl plastic mechanically bonded to the plastic foam, as exemplified in the U.S. Pat. No. 4,034,528 to Sanders et al, have not proven to be satisfactory in use as exterior siding. A disadvantage of this type of building panel is that the thin facing layer of vinyl chloride, or other similar thermoplastic, readily expands under ambient heating and warps and wrinkles because it is only mechanically bonded to a rigid plastic foam layer having a highly different coefficient of expansion. This warping and wrinkling of the facing layer, while undesirable in and of itself, also results in the bond between the facing layer and the foam insulation being broken which, in turn, results in voids through which moisture can penetrate the building panel. Since the expanded foam insulation and similarly described plastic foams are highly susceptable to absorption of moisture, the moisture entering the voids is readily absorbed by the foam insulation and passes from the foam insulation via those voids as changes in ambient weather conditions occur. This resultant cyclical and rapid absorption and loss of moisture over a wide range of conditions normally encountered under ambient environmental conditions causes structural deterioration of the foam insulation because of its dimensional changes, especially in the lateral direction, diminuation of its insulating capability and potential rotting of the wood support structure on which the panels are mounted. The building panel of this invention overcomes the aforesaid shortcomings of the heretofore known building panels of vinyl and thermally insulated type.

It is therefore an object of this invention to provide a building panel for exterior use which has a relatively long operative life during which thermal insulation and resistance to moisture penetration is optimal.

Another object of the present invention is to provide a building panel for exterior use of laminated construction, having a thermal insulating layer and a plastic outer weather resistant layer, in which deformation of the building panel is obviated.

Another object of this invention is to provide a building panel for exterior use of laminated construction having a thermal insulating layer and an outer layer of plastic, which is relatively stiff and having dimensional integrity under a wide range of ambient weather conditions.

A further object of the present invention is to provide a building panel for exterior use of laminated construction, having a lamination of foam insulation material, in which any cyclical absorption and release of moisture by the foam insulation under fluctuating ambient weather conditions of temperature and humidity is substantially negated.

A still further object of this invention is to provide a method of fabricating a building panel for exterior use of laminated construction, having a layer of thermal insulation and a plastic outer weather resistant layer, in which building panel the structural integrity of the plastic outer layer is maintained and moisture penetration is minimize throughout the operative life of the building panel.

SUMMARY OF THE INVENTION

The present invention overcomes the disadvantages of the prior known building panels by providing a panel for exterior use, of laminated construction, comprising an outer or facing layer of weather resistant plastic which is relatively thin, preferably between about 1.5 mils to about 3 mils in thickness, bonded to a layer of compressed wood fibre board or hardboard and a rigid layer of foam plastic, having heat insulating properties, bonded to the hardboard on the surface thereof opposite the surface to which the outer layer is bonded. In this laminated building panel, warping and wrinkling of the relatively thin outer layer of plastic and the creation of voids or gaps at the interface between the outer layer and hardboard is eliminated so that an effective moisture barrier is provided to protect the hardboard substrate from cyclical absorption and loss of moisture as changes in ambient temperature and humidity conditions occur. A moisture resistant, non-absorbent, extruded plastic foam bonded to the hardboard sheet serves, in a like manner, to effect a moisture barrier. It is a building panel, having an outer thin film of weather resistant plastic, which is stiff and resistant to deformation by high velocity winds and resists denting or other damage from impact by hailstones, rocks, or the like.

In a narrower aspect of this invention, the outer layer is preferably a four-sided polygonal sheet of a high temperature thermoplastic material, as for example, polymethylmethacrylate or copolymers thereof or polyvinylflouride or copolymers thereof, which is not subject to softening or deformation under normal ambient heating conditions.

The method of fabrication according to the present invention of a building panel of laminated construction, having a flat sheet of hardboard of polygonal configuration, a flat sheet of high temperature thermoplastic material coextensive with the hardboard sheet lying adjacent one surface of the hardboard sheet and a rigid layer of foam plastic of heat insulating properties disposed adjacent the surface of the hardboard sheet opposite from the sheet of thermoplastic material, comprises the following steps. First, bonding the flat sheet of thermoplastic material to the adjacent surface of the hardboard sheet. Secondly, forming a V-shaped groove in the hardboard inwardly of and parallel to one edge of the hardboard sheet to a depth such that the apex of the V-shaped groove is substantially at the inner surface of the flat sheet of thermoplastic material without penetration of such inner surface. Next, the thermoplastic flat sheet is heated adjacent the V-shaped groove. This heating step is followed by applying an adhesive, preferably of the contact type, to at least one side of the V-shaped groove. Next, the hardboard sheet is folded along the apex line of the V-shaped groove to bring the two sides of the groove together, the thermoplastic material serving as a hinge. The last step is the adhesive bonding of the rigid layer of a plastic foam to the surface of the hardboard opposite from the thermoplastic material.

In a narrower aspect of the fabrication method according to this invention, it has been found preferable to form the V-shaped groove so that the angle between the two sides of the groove is about 80°. This insures that, upon deformation of the thermoplastic sheet at the V-shaped groove as the fold is made to bring the sides of the groove together, the stress thereon will not be beyond its elastic limit thus avoiding fracture of the thermoplastic sheet.

BRIEF DESCRIPTION OF THE DRAWINGS

The invention will be more readily understood from the following detailed description thereof when considered with the accompanying drawing wherein several embodiments of the invention are illustrated by way of example and in which:

FIGS. 6, 7 and 8 show three alternative preformed openings for mounting fasteners by which the building panels are held to a support structure;

FIG. 9 is a cross section view taken along line 9—9 of FIG. 6 and showing in phantom, how a building panel may be disengaged from the fasteners; and FIGS. 10, 11 and 12 illustrate three of the steps of the method of fabrication according to this invention.

DESCRIPTION OF THE PREFERRED EMBODIMENTS OF THE INVENTION

Figure 1:
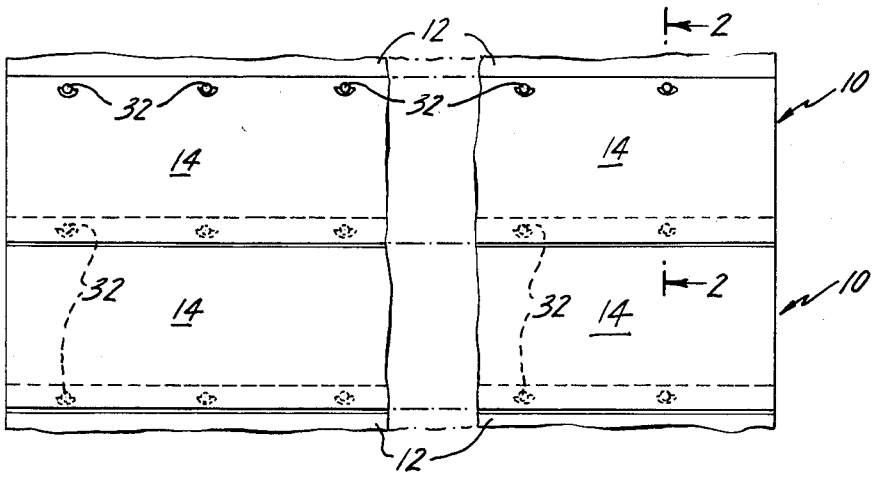
FIG. 1 is a fragmentary view, in elevation of a wall to which is applied building panels according to the invention.
Figure 2:
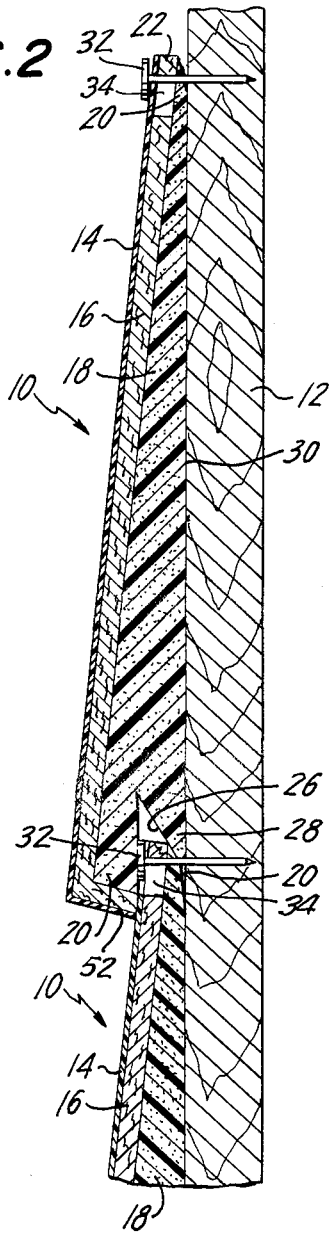
FIG. 2 is a cross sectional view taken along line 2—2 of FIG. 1, greatly enlarged.

Now, referring to the drawings and, more particularly, FIGS. 1 and 2, the reference number 10 generally refers to the building panel for exterior use according to this invention. A plurality of building panels 10 may be secured to a support structure, such as a plywood sheet 12 or to lathing (not shown) or the like, in interlocking relationship as best shown in FIG. 2, to form a wall covering similar to clapboard siding. Each building panel 10 is of laminar construction consisting of three layers bonded together into a unitary structure.

The outer facing layer 14 is of weather resistant material such as a thermoplastic material, preferably a vinyl plastic having a high temperature melting point, as for example, polymethylmethacrylate or copolymers thereof or polyvinylflouride or its copolymers, and in the form of a premanufactured sheet of four-sided polygonal configuration. The outer surface of the sheet may be contoured or embossed to a simulate wood grain or be smooth. The sheet 14 is thin, preferably about 1.5 mils to about 3 mils in thickness. This outer layer or sheet 14 is chemically bonded by a suitable adhesive, as for example, an epoxy adhesive manufactured by Key Polymer Corp. of Lawrence, Mass. and designated type Key Epoxy C1-34A/B, to a backing layer 16 of a structural board. The backing layer 16 is a board consisting of reconstituted wood fibers pressed into a relatively thin board, preferably about one-eighth inch in thickness. The layer 16 will hereinafter be referred to as a "hardboard sheet". The hardboard sheet 16 is dimensioned to be coextensive with outer sheet 14.

Figure 3:
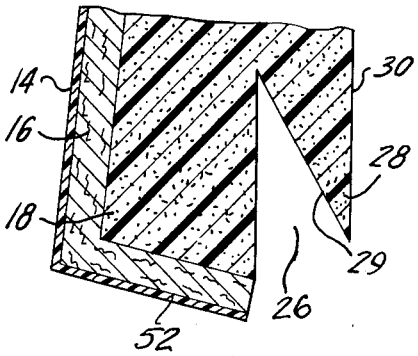
FIG. 3 is a fragmentary view of one form of notch located along the lower edge of the building panel shown in FIG. 1.

The third layer 18 of the laminated building panel 10 consists of a low density, rigid plastic foam material which is light in weight and has heat insulating properties. The foam layer 18 is chemically bonded to the surface of the hardboard sheet opposite the outer sheet 14 by a suitable adhesive, as for example, a urethane adhesive, such as Q-Thane, QR4773 manufactured by K. J. Quinn & Co., Inc., of Seabrook, N.H. or an adhesive manufactured by Morton Thiokal, Inc. of Chicago, Ill. designated Morad 434 and sold under the trademark, "MORAD". The layer is preferably of a tapered cross sectional configuration where the building panels 10 are to be used to simulate wood clapboard siding as is shown in FIG. 1. The foam layer 18, at its upper and narrow end portion 20, is preferably beveled, and terminates at the upper edge portion 22 of hardboard sheet 16 as shown, or may terminate in close, spaced relationship to the edge of the hardboard sheet 16, as for example, about ¼ inch inwardly of the edge of the hardboard sheet 16. Where building panels 10 are applied to simulate clapboard siding, the abutting lateral ends of adjacent building panels 10 are covered by conventional clips (not shown). As best shown in FIG. 3, the lower end portion 24, of the foam layer 18, is provided with groove or notch 26, which is of V-shape and dimensioned to receive therein the upper end portion 22 of the hardboard sheet 16 of a lower adjacent panel 10 as shown in FIGS. 2 and 9. The notch 26 forms with the exposed surface 30 of building panel 10 a lip or tab 28. The interlocking relationship provided by notch 26 and the upper end portion 22 serves two functions. One of the functions is to anchor the lower end of panel 10 by clamping lip or tab 28 between the support structure 12 and the upper portion 22 of hardboard sheet 16. The other function is to provide, by the abutment of tab 28 of layer 18 against the beveled end portion 22 of the layer 18 of the adjacent building panel, a continuous moisture and heat barrier at the interconnection of the adjacent building panels 10.

The attachment of building panels 10 to support structure 12, is achieved by fasteners, such as nails 32, which pass through a plurality of preformed openings 34 extending in spaced relationship parallel to and adjacent the upper edge portion 22 of hardboard sheet 16. As best shown in FIG. 6, each of the openings 34 is of elongated configuration and is defined by two juxtaposed, arcuate surfaces 36 and 38 which converge at their opposite ends. It is preferred that the nails 32 not be driven "home" or "set" but are driven into support structure 12 only far enough to serve as hangers so that the nail heads function to restrict movement of the building panel outwardly away from the support structure. This type of opening and method of mounting the building panels permits each of the building panels to slide or displace horizontally in the unlikely event of any dimensional changes in the building panel. This freedom of movement of the building panel 10 avoids any possible deformation of the surface of the building panel. Also, as illustrated in FIG. 6, the arcuate surfaces 36 of openings 34 serve to provide, with nails 32, a self-centering function. In addition, the openings 34 are so dimensioned relative to the size of the nail heads, that only a portion of the nail head engages the plastic sheet 14 and hardboard sheet 16 and only requires a relatively small upward movement of building panel 10 to be clear of the nail head, thus facilitating the removal and replacement of building panels as will be more fully described hereinafter.

In FIG. 7 is shown an alternative opening 34A for facilitating the mounting of building panels 10. The opening 34A is defined by an upper arcuate shaped wall 36A, similar to wall 36 of openings 34, and thus provides the same self-centering function. The opposite wall 38A is closer to wall 36A than the spacing of walls 36 and 38, and therefore wall 38A is provided with a centrally located curved recess 40 which is so sized, that the nail head of a nail 32 can pass through opening 34A upon removal or replacement of a building panel 10.

In FIG. 8 is shown another alternative configuration of nail openings for building panel 10. The opening 34B, shown in FIG. 8, has a relatively flat upper surface 36B with a centrally located arcuate recess 42 which abutts the shank of nail 32 and thereby provides a self-centering function. To provide space in opening 34B for passage of the nail head, through opening 34B, in the event of removal and replacement of a building panel 10, the lower wall of opening 34B is formed of two arcuate surfaces 40A which intersect the opposite ends of flat wall 36B and intersect each other in a plane extending through the axis of arcuate recess 42.

As best shown in FIG. 3, notch 26, in foam layer 18, has a V-shape cross section, which defines with the surface 30 of layer 18 the lip or tab 28. Alternatively, notch 26, may have a cross sectional configuration as is illustrated in FIGS. 4 and 5.

Figure 4:
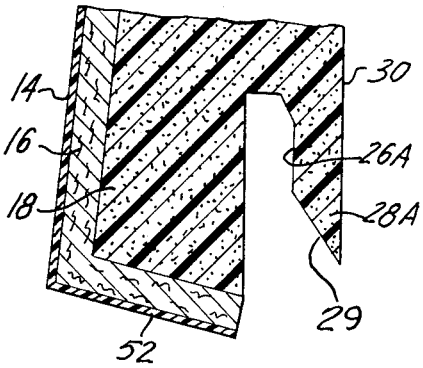
FIGS. 4 and 5 are fragmentary views similar to FIG. 3 showing two other forms of notches according to this invention.
Figure 5:
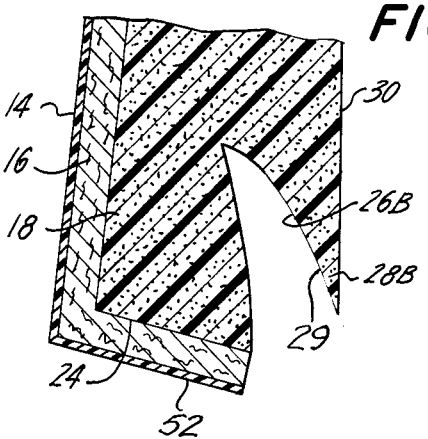

In FIGS. 4 and 5 the parts corresponding to parts shown in FIGS. 1 and 3, will be identified by the same numbers but with the suffix A added in FIG. 4 and the suffix B added to the numbers in FIG. 5. As is shown in FIGS. 4 and 5, the notch 26A in foam layer 18 has a tab 28A while notch 26B has a tab 28B, both tabs 28A and 28B are functionally the same as described with respect to tab 28 of notch 26. All three notch configurations shown in FIGS. 3, 4, and 5, have inclined camming surfaces 29 which coact with the upper edge portion 22 of hardboard sheet 16 to achieve the wedging action which effects a tight-fitting interlocking joint between adjacent building panels 10 and a seal by abutment of tab 28 against beveled upper end portion 22 of next adjacent layer 18.

The herein described building panel 10, when utilized in simulating a clapboard siding, is capable of being removed and replaced relatively easily. The removal of a building panel 10 is accomplished by forcing the building panel 10 to be removed upwardly to a position as shown in phantom lines in FIG. 9 where the head of nails 32 are aligned with openings 34. This upward displacement of the building panel to be removed also disengages or frees the tab 28 from between the upper edge portion 22 of hardboard sheet 16 of building panel 10 located below the building panel to be removed and support structure 12. The building panel 10 now can be pulled outwardly away from the support structure, past nails 32 and free of the adjacent building panels. To re-hang a replacement building panel 10 the reverse steps are followed with the final step being the forcing of the replacement building panel downwardly to bring the nails to 32 into abutment against walls 36 of openings 34 as shown in FIG. 6, and tab 28 at the lower portion of the building panel wedged between support structure 12 and the upper end portion 22 of hardboard sheet 16 of the building panel below as shown in FIGS. 2 and 9.

Method of Fabrication

The building panel 10 is fabricated as herein described with reference to FIGS. 10, 11 and 12. First, the premanufactured thermoplastic sheet 14 is bonded by an adhesive, as for example an epoxy adhesive previously mentioned herein, to the hardboard sheet 16. Next, as shown in FIG. 10, a V-shaped groove 50 is formed in the hardboard inwardly from and parallel to one of the end edges. The groove 50 may be cut by a cutting wheel 51 represented in phantom lines in FIG. 10 to a depth substantially at the thermoplastic sheet 14, and without penetration into the surface of thermoplastic sheet 14. An adhesive, as for example a contact adhesive, is applied to at least one of the surfaces of groove 50. The thermoplastic sheet 14, in at least the area adjacent groove 50, is heated to a temperature between about 55° C. to about 80° C. where the thermoplastic sheet 14 is either polymethylmethacrylate or copolymers thereof or polyvinylflouride or its copolymers. As show in FIG. 11, the hardboard strip 52, which is formed between groove 50 and the edge of the hardboard sheet 16, is folded to bring the two surfaces of groove 50 together, the thermoplastic sheet at the point of bend serving as a hinge during the folding step. The adhesive applied to the groove surface secures the groove surfaces tigether to permanently hold strip 52 as a fixed flange. It has been found preferable that groove 50 be formed with the surfaces of the groove at about 80° from each other; that is where each surface of groove 50 lies in a plane at a 40° angle to a plane through the apex of the groove and extending normal to the surface of hardboard 16. This angularity of the side walls of groove 50 insures that, upon deformation of the thermoplastic sheet adjacent groove 50, during the folding operation, the thermoplastic sheet will not be stressed beyond its elastic limit and therefore will not be fractured. This guarantees the non-penetrability or impermeability of thermoplastic sheet 16. Following the folding operation, the rigid foam layer 18 is chemically bonded to the surfaces of hardboard sheet 16, including surface of strip 52. The rigid foam layer 18 may have notch 26 and the tapered configuration formed prior to bonding to hardboard sheet 16 or after such bonding.

It is believed now readily apparent that the present invention provides a building panel for exterior use of laminated construction which provides an effective heat and moisture barrier and is highly resistant to deformation under usual ambient weather conditions. The building panel 10 provides a wall covering which is weatherable, does not require painting or other finishing or maintenance of that type, is water resistant, aesthetically pleasing, easy to apply, imparts insulative values to the wall system, does not require an underlayment or presurfacing of an of an existing wall to which the panel is to be applied and is highly functional in its intended application. It is a building panel which is capable of application to simulate clapboard siding. The present invention also provides a method of fabrication of building panel 10 which method is relatively simple and yet insures that the building panel will be an effective moisture and heat barrier and have a relatively long operative life.

Although several embodiments of the invention have been illustrated and described in detail, it is to be expressly understood that the invention is not limited thereto. Various changes can be made in the arrangement of parts without departing from the spirit and scope of the invention as the same will now be understood by those skilled in the art.

What is claimed is:

1. A building panel for exterior use of laminated construction comprising:

(a) a flat sheet of hardboard having a four-sided polygonal configuration and first and second planar surfaces;

(b) a flat sheet of high temperature thermoplastic material bonded to said first planar surface of the hardboard and being substantially coextensive therewith to provide an outer planar surface;

(c) said laminated hardboard sheet and thermoplastic sheet having first edge portion and an opposite integral offset portion extending in a plane substantially normal to the outer planar surface of the thermoplastic sheet and terminating in a second end edge portion; and (d) a rigid layer of plastic material having insulating properties bonded to the second planar surface of the hardboard.

2. The article of claim 1 wherein said foam plastic has a third planar surface extending at an acute angle to the outer planar surface of the thermoplastic sheet so that in cross section the foam plastic layer has a large cross sectional dimension adjacent said second end edge portion of the offset portion and a narrow cross sectional dimension adjacent said first edge portion.

3. The article of claim 2 wherein said foam plastic layer at said large cross sectional dimension extends beyond the second end edge portion of said offset portion and a notch is provided in the foam plastic layer adjacent the second end edge portion and extending beyond said second end edge portion; said notch being dimensioned to receive the laminated hardboard and thermoplastic sheets of another building panel.

4. The article of claim 3 wherein said notch has a V-shaped configuration.

5. The article of claim 3 wherein said notch consists of two intersecting curved surfaces to form a line of intersection.

6. The article of claim 5 wherein the two curved surfaces of said notch extend toward said hardboard, the line of intersection of said curved surfaces lying in a plane offset from an imaginary plane of the second end edge portion of said offset portion.

7. A building panel of laminated construction for exterior use, said panel adapted to be mounted on a support structure, comprising:

(a) a flat sheet of hardboard having a four-sided polygonal configuration with an upper and lower edge portion;

(b) a flat sheet of high temperature thermoplastic material bonded to one surface of the hardboard and being substantially co-extensive therewith to form a first outer weather resistant surface;

(c) a rigid layer of foam plastic material having thermal insulating properties bonded to another surface of the hardboard opposite from the flat sheet of thermoplastic material and having upper and lower edge portions and providing a second outer surface substantially co-extensive with the hardboard sheet;

(d) said layer of foam plastic having, in cross-section, a tapered configuration with said outer weather resistant surface of said flat sheet of thermoplastic material and tapering from the lower edge portion thereof to the upper edge portion thereof;

(e) a notch in and co-extensive with said lower edge portion of said layer of foam plastic; and (f) said notch being of a size to receive the upper edge portion of another building panel and having a configuration in cross-section to form with said second outer surface of the rigid layer of foam plastic material a tab having a camming surface which coacts with the upper edge portion of another building panel to urge the tab against the support structure.

8. The article of claim 7 wherein the notch is of V-shape in cross section.

9. The article of claim 7 wherein said notch is formed by two intersecting curved surfaces.

10. The article of claim 7 wherein said camming surface intersects the second outer surface of the rigid layer of foam plastic material to form said tab.

11. A building panel of laminated construction for exterior use in combination with a plurality of fasteners each of which has a shank portion and a head portion of larger peripheral dimensions than the shank portion for securing the building panel to support structure, the panel comprising:

(a) a flat sheet of hardboard having a four-sided polygonal configuration comprising first and second planar surfaces and an upper, lower and side edge portions;

(b) a flat sheet of high temperature thermoplastic material bonded to said first planar surface of the hardboard and substantially co-extensive therewith;

(c) a rigid layer of foam plastic material having thermal insulating properties bonded to the second planar surface of the hardboard;

(d) a plurality of spaced openings in said hardboard and thermoplastic material each of which is aligned to receive a fastener; and (e) each of said aligned openings being elongated and having one side thereof substantially arcuate in shape and dimensioned to allow the head portion of an associated fastener to pass therethrough when the building panel is removed from and replaced on the support structure.

12. The article of claim 11 wherein each of said aligned elongated openings is defined by flat surfaces extending on opposite sides of a centrally located curved recess in spaced relationship with said arcuate side and with the flat surfaces extending to intersect the arcuate side at points spaced from the curved recess.

* * * * *